United States Patent [19]

Tarantola

[11] 4,299,082

[45] Nov. 10, 1981

[54] METHOD AND MACHINERY FOR MANUFACTURING METALLIC CORDS IN LAYERS

[75] Inventor: Luciano Tarantola, Milan, Italy

[73] Assignee: Industrie Pirelli S.p.A., Milan, Italy

[21] Appl. No.: 116,205

[22] Filed: Jan. 28, 1980

[30] Foreign Application Priority Data

Feb. 6, 1979 [IT] Italy ..... 19915 A/79

[51] Int. Cl.[3] ..... D07B 3/00

[52] U.S. Cl. ..... 57/9; 57/58.3; 57/311

[58] Field of Search ..... 57/6, 9, 13, 15, 58.3, 57/58.32, 58.34, 58.36, 58.38, 311

[56] References Cited

U.S. PATENT DOCUMENTS

| | | | |
|---|---|---|---|
| 3,309,857 | 3/1967 | Haugwitz | 57/58.36 X |
| 3,425,203 | 2/1969 | Schillebeeckx | 57/58.36 |
| 4,141,205 | 2/1979 | Berges et al. | 57/58.32 |
| 4,195,469 | 4/1980 | Tarantola | 57/311 |

*Primary Examiner*—Donald Watkins

*Attorney, Agent, or Firm*—Stevens, Davis, Miller & Mosher

[57] ABSTRACT

A method and apparatus for making a cord to be used for reinforcing an elastomeric article such as a tire for a motor vehicle are disclosed. The cord has a core formed by twisting together a group of wires and a series of radially disposed crown layers of wires wound helically about the core or next innermost crown layer side by side and parallel to each other. The apparatus has two machines each having a cage and a shuttle disposed in the cage for winding crown layers from bunches of wires. A device for flexing the wires used to form the crown layers to deform them before winding is included. The two machines are coupled together by a device which determines the relative speeds of rotation of the first and second cages at a 2:1 ratio, respectively.

21 Claims, 4 Drawing Figures

METHOD AND MACHINERY FOR MANUFACTURING METALLIC CORDS IN LAYERS

This invention relates to the manufacture of metallic cords and especially those cords used for reinforcing elastomeric articles such as vehicle tires, tapes, belts and the like. More particularly this invention relates to the manufacture of metallic cords in layers, i.e. cords having a central core and a crown around the core formed from one or more layers of wires which are co-axial to the core.

Both, the core and each of the various layers can be a group of metallic wires (that henceforth, in this text, we shall refer to as "elementary wires") or of "strands" of elementary wires. The term "strand" is used herein to mean cords consisting of a plurality of elementary wires twisted together or an assembly of elementary wires and strands of various formations.

In the present description, those elements constituting the cord will be referred to generally as wires intending by this, that they may consist either of elementary wires or component strands.

For manufacturing the type of cords just described, a machine usually called a "laying" machine, is generally employed. By the means of this machine, a bunch of wires, as many as are needed for constructing the crown layer of the cord, is helically wound around the cord core, i.e. if the radially innermost layer is concerned; or otherwise, around the radially innermost portion of the cord, i.e. that portion consituted by the core and by the crown layers which are already wound around the core.

The cord is formed in successive phases or steps, each step involving winding a successive crown layer onto the previous, already formed cord portion, i.e. on the core, and on the crown layers radially innermost, until such time as the desired formation is obtained.

Taking as an example, a cord 3S+9S+15Z, has a central core composed of a "strand" of three wires twisted together in S-shaped turns, and having an intermediate crown layer constituted by nine single wires disposed side-by-side, and wound around the core, using the same S-shaped turns, and finally, by an external crown layer of fifteen single wires wound around, in the reverse direction, i.e. in Z-shaped turns over those portions of the cord that include the core and the intermediate layer.

The terms "S-winding" and "Z-winding" are well-known to those skilled in the arts, and are commonly used by them. Hence, no further explanation is needed here.

The formation of the cord therefore, takes place in three successive phases, i.e. with the phases of: (1) forming the core; (2) winding the first layer around the core; and (3) winding the second layer around the first layer.

These three phases are not usually carried out simultaneously on one and the same machine, or in a continuous process. The intermediate product of each phase is collected on bobbins before proceeding to the next one.

With the existing "laying" machines it is not possible, as a matter of fact, to wind simultaneously two or more layers, or to cable the core and to wind it simultaneously with the radially innermost crown layer.

It becomes clear therefore, that the process for forming the cords is both long and costly. This is even more so, when the structure of the cord is more complex, i.e. when the number of crown layers has to be larger.

Besides this, the number of wires required for these layers (for the obvious reason of filling up the geometrical section) increases as the radial distance from the core increases. In fact, as is apparent from the above example of a 3S+9S+15Z cord, the intermediate layer contains nine wires, whereas the outer layer contains fifteen wires.

As a result of this fact, and owing to the large number of bobbins required (one bobbin per wire), the presently used machines have to be very voluminous and heavy, resulting for this reason, in being slow as well.

A primary object of the present invention is to furnish a rapid and economical method for constructing metallic cords in layers which have improved qualitative characteristics, and, at the same time, also to increase the production output by adoption of fast-producing machines in the plant. Another object of the invention is to provide a method for making metallic cords in a single sequence of steps, without winding a partially finished cord on a bobbin before proceeding to the next step.

A further object of the present invention, is to provide an apparatus which is specifically adapted for carrying out the new method.

Other objects will become apparent from the following description with reference to the accompanying drawing wherein FIG. 1 is a cross-section of one embodiment of a cord manufactured by the process of the invention identified as a 3S+9S+15Z cord, i.e. a cord having a core of three wires twisted together to form a strand, a first circumferential layer helically wound immediately about the core strand composed of nine distinct wires substantially parallel to each other and a second circumferential layer of 15 substantially parallel wires helically wound immediately over the first layer;

Figure 2:
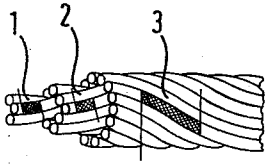
FIG. 2 is a side elevation of a longitudinal segment of the cord of FIG. 1.

The foregoing objects and others are accomplished in accordance with this invention, generally speaking, by providing a method for making metallic elements or cords adapted for reinforcing elastomeric articles such as vehicle tires, the elements having a plurality of elementary wires twisted together forming a strand which extends longitudinally through the element as an uncabled core and at least one crown layer helically wound about the core strand, the individual wires of each crown layer being substantially parallel to each other. The cord may have a plurality of crown layers of helically wound parallel wires with each crown layer radially outward of the one wound immediately about the core strand being wound directly over the adjacent radially inner crown layer. In forming the crown layer, a group of the required number of wires for providing a covering layer over the immediately radially inner crown layer is assembled for winding helically as a group about the radially inner layers, the wires so assembled are permanently deformed flexionally and wound helically over the immediately radially inner layer while disposed substantially parallel to each other.

Therefore, the invention provides a method for making metallic cords, in particular for making cords to be utilized specifically as a reinforcing element in elastomeric structures, the cords having a central core and at least one crown layer, the elements of the cord being defined generally as "wires" which may be either single metallic wires or strands of wires and with the wires of each crown layer being helically wound, and parallel to each other, around the radially innermost layers and the central core, as well, the method being carried out through first pre-disposing the pay-off of a first group of wires that comprise the cord portion which has to be enveloped within a crown layer, and the pay-off of a second group of wires for constituting the crown layer, and by then applying to the wires of the groups, a force that is capable of achieving the distribution of the wires fed from their relative pay-off bobbins, and next to permanently deform, at least flexionally, these wires of the said second group and to confer to them a rotation for winding the said wires helically and parallel to each other around the cord portion which has, for this purpose, been brought into contact with the wires of the second group, thereby forming a crown layer, and thereupon, to guide the so-formed cords towards a "collecting device" with the direction of movement of the cords, at the point of the formation of the crown layer, being defined as the 'advancing direction', said method comprising, in the following order, the steps or phases of:

(a) distributing the second group of wires in the form of a bundle of distinct wires which are not cabled together;

(b) rotating the wires twice in the same sense defined as being torsions, with respect to the above-said sense so as to realize a double-twisted strand;

(c) conferring to said strand, an un-twisting with the same entity as that of the two previous torsions in this way to separate said strand into the wires which comprises it, and with thereupon disposing these wires, both parallell and side-by-side to each other;

(d) conferring to the thus disposed wires that are also permanently deformed by flexions, a torsion having the same entity as that of the previous "untwisting" with simultaneously winding the said separated wires around the wires of the said first group, in such a way as to realize the crown layer on said cord portion.

First and foremost, for reducing any disturbance of the material during the manufacturing process of the cords, it has proved advantageous to confer to the wires of the second group the relative permanent deformation by flexions successively to the "un-twisting operation".

Besides this, for having an opportune realization of the method described, the two successive torsions are conferred to the wires of the second group, by pulling the wires along a first trajectory that rotates around on axis, but which is not coincident with it, but with the initial and end tracts laying on the axis, the directions of the movement of the wires along the trajectory, in the initial and end tracts, being opposed to each other. Similarly, even the un-twisting and the successive torsions, are conferred to the wires by pulling them along a second trajectory that rotates around an axis but not being coincident with the axis, and with the initial and end tracts lying on the axis, with the directions of the movement of the wires (along the trajectory in the initial and end tracts), also in concordance with each other.

What is also quite opportune, is the fact of the rotation speed of the second trajectory, which has the same sense and moreover a double entity, as with respect to the rotation speed of the first trajectory; moreover of the directions of movement of the second group of wires, in the tracts, respectively the end tract of the first trajectory and the initial tract of the second trajectory, being in this instance, concordant one with the other.

This method can be quite advantageously utilized for producing, in a single phase, the central core and the crown layer that is immediately adjacent to it. In this case, the method will comprise, in the order of sequence, also the operations, of distributing the first group of wires in the form of a bundle of distinct wires, which are not cabled together, by reciprocally disposing them parallel and side-by-side; of permanently deforming, by flexions, the thus-disposed wires; of conferring successive double-torsions to the wires, and in the same sense, with thus obtaining in this manner, a double-twisted strand comprising the central core. The two successive torsions are conferred to the wires of the first group by the same rotary movement used for conferring the "un-twisting" and successive torsions, to the wires of the second group.

Furthermore, for obtaining conveniently the method described, it is feasible for the defined "advancing direction" of the cords, and for the axis of rotation of the trajectories, to be disposed co-axially one with the other, in linear succession.

For the purpose of conveniently practicing the method of the invention, a second object of the present invention is to provide an apparatus for producing the metallic cords provided by the invention, the apparatus being characterized by the fact of comprising:

(a) a first machine of the double-torsion type, having a cage rotating around its own axis and a shuttle, co-axial to the cage and disposed inside the latter and freely rotating around its own axis, and being adapted for sustaining the means for distributing a first group of wires constituting the cord portion onto which a crown layer has to be wound;

(b) a second machine of the double-torsion type, substantially like the first machine; the shuttle of the second machine being adapted for sustaining the means for distributing a second group of wires in the form of a bundle of distinct wires for producing the crown layer;

(c) conventional pre-forming device, adapted for permanently deforming, at least by flexions, the wires of the second group;

(d) a device for coupling together the first and second machines, and being also adapted for differentiating the rotation speeds of their relative cages, with maintenance of the velocities respectively, at a constant ratio of 2:1;

(e) conventional means, for pulling the wires for stabilizing the torsions, and for collecting the cords as they are produced.

According to a convenient form of the machine, the "distributing means" for the first group of wires, comprises a bobbin, freely rotating around its own axis which is disposed on a relative shuttle normal to the axis of the corresponding cage, the bobbin containing the cord on which the crown layer has to be wound; whereas the "distributing means" of the second group of wires, comprises a plurality of bobbins, each one of which has a single wire, these bobbins being equal to the number of wires which are to constitute the crown layer, and with each bobbin freely rotating around its own axis which is disposed on the shuttle, normal to the axis of the corresponding cage. The pre-forming device, according to a particularly suitable conventional version is also constituted by a small roller that is freely rotatable around its own axis disposed perpendicularly with respect to the cage axis.

Besides the above pre-forming roller, the two machines described above also comprise another plurality of rollers for constituting the "means" for guiding the wires. In particular, the second machine comprises guiding rollers for drawing the wires of the second group along a trajectory which is initially coincident with the axis of the cage—with traversing said cage from the inside towards the outside, and hence, developed along the external surface of the cage to finally coincide, once again, with the axis of the cage in an external position to the cage, the direction of movement of the wires, along the trajectory, being one opposed to the other in the two tracts that are coincident with the cage axis.

The first machine also comprises guiding rollers for drawing the wires of the second group along a trajectory that is always outside of its own cage, and initially coincidental with the axis of the cage and hence, developed along the external surface of the latter, and finally, once again coincident with the axis of the cage; the moving direction of the wires, along the said trajectory, being coincident with one another in the two tracts coinciding with the cage axis.

The realization of the said trajectories is facilitated through disposition of the machines, according to which the axes of the two cages and the "advancing direction" as defined, are disposed so as to be co-axial to one another and in linear succession.

In such instances, the pre-forming pin of the second group of wires, likewise, quite conveniently constitutes also the guiding means for the trajectory of wires on the first machine where the trajectory again becomes coincident with the axis of the corresponding cage.

Furthermore, quite advantageously, the machine described can be utilized for forming in a single phase, the central core as well as the radially innermost layer of the cord. In such cases, the distributing means of the first group of wires, distributes the wires in the form of a bundle of distinct wires, the distributing means being, for example, constituted by a plurality of single headed bobbins, or by a plural headed single bobbin. In both cases, the number of heads are equal to the number of wires consituting the central core. Moreover, the first machine also comprises a further preforming device for permanently deforming, at least by flexions, each one of the wires of the first group, and a plurality of guiding rollers for drawing the wires along a first trajectory coincident with the axis of the corresponding cage, with traversing it, from the inside towards the outside, and then developing it along the external surface of the cage, to be finally, once again, coincident with the axis of the cage that is external to it. The directions of the movement of the wires along the said trajectory are opposed to one another in the two tracts that coincide with the cage axis.

Even in this case, the pre-forming device cited may conveniently be also a roller that functions as a 'guiding means' for drawing the wires of the first group up to the point where the trajectory after having traversed the cage in coincidence with its axis, is drawn away from it.

In any case, the present invention will now be better understood with the aid of the following description and from the attached drawing given solely by way of non-limiting example.

Figure 1:
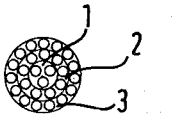

The cord of FIG. 1, i.e., the 3S+9S+15Z cord, has a core 1 which is a strand of three single metallic wires that are twisted together.

On this strand, there is wound a first layer for crown 2 of nine single metallic wires, and over this, there is wound a second layer for crown 3 having fifteen single metallic wires.

The winding direction for the core and for the crown layers can be noted clearly in the drawing (S or Z) as represented in FIG. 2, and hence, no further explanation or comment is required.

Figure 3:
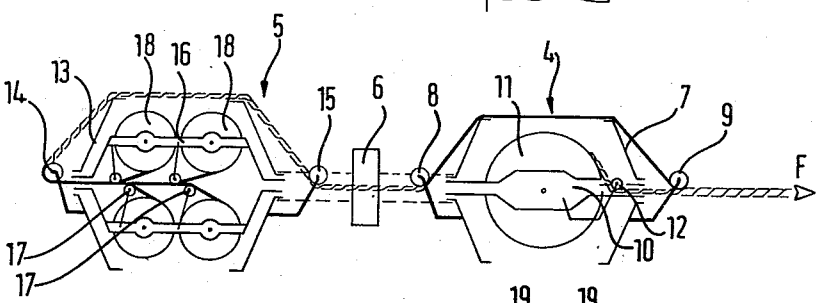
FIG. 3 is a schematic side view of an assembly of apparatus for practicing the method of the invention to build up the cord in accordance with the method of this invention.
Figure 4:
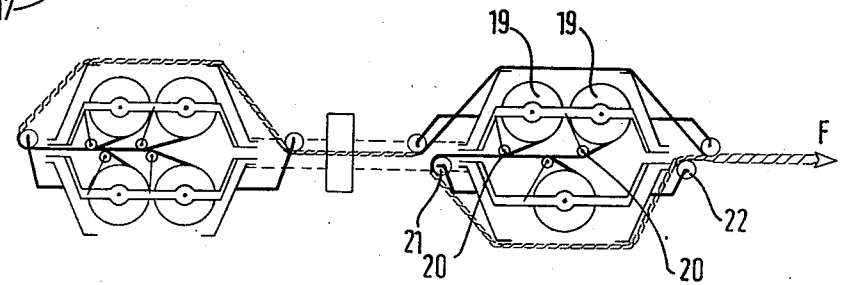
FIG. 4 is a second embodiment of an apparatus illustrated in the same way that the one of FIG. 3 is illustrated.

The FIGS. 3 and 4, illustrate two versions (the second of these versions is more versatile than the first), with regard to the same plant for realizing the said cords, or, to be more precise, for realizing the diverse working phases of the cabling process for the cords.

The apparatus of the plant (solely the devices relative to the 'novelty' of the process are illustrated), is represented in a schematic form—and purely as regards its functionality, since the various devices are mechanical elements that are already well known per se to technicians of this field.

This plant comprises hence, a first cabling machine 4 of the 'double-torsion' type that is connected to a second machine 5 of the 'double-torsion' type, by means of a coupling device 6.

Naturally, there also exists (even though not represented in the Figures) the supporting framework for the two machines, and also various actioning devices, as well as a collecting device for the cords when they are produced. Furthermore, the usual treating-devices such as, for example, the capstan and the mock-twister used for eliminating any residual tensions in the manufactured cord, are also present.

Returning now to the specific aspect of the invention, machine 4 comprises a cage 7 which rotates around its own axis, cage 7 being fixed with two return-rollers 8 and 9 which are disposed respectively, upstream and downstream of the cage 7, i.e., with respect to the cord movement; with the downstream return-roller 9 also acting as a pre-former pin.

It is to be noted that this pre-former pin, is a specific version of the device for conferring permanent deformations, at least flexionally, to the wires comprising the cord. In particular, this pre-former pin deforms the wires that are wound onto it, at least partially during the course of their movement through the plant.

Within cage 7, and co-axial to it, there is disposed a shuttle 10, which rotates freely around its own axis and which supports bobbin 11 (also freely rotating around its own axis) which is disposed normal to the axis of the cabling machine 4.

Made fast with shuttle 6, there is also to be found the axis of another roller 12, disposed for guiding the wires payed-off by bobbin 11.

The double torsioning machine 5, is quite similar to the machine 4; it also comprises a cage 13 made fast with the return rollers 14 and 15 that are disposed respectively upsteam and downstream with respect to the direction of movement of the wire; a shuttle 16, co-axial with the cage 13 and inside it, and freely rotating around its own axis and made fast with the axes of a plurality of wire-guiding rollers 17, and adapted for sustaining a plurality of bobbins 18.

The two machines 4 and 5, are disposed in a line, co-axial and connected to one another through a coupling device 6, that establishes and maintains constant a pre-fixed ratio of 2:1 between the respective rotation speeds of the cages 7 and 13. In other words, the rotation speed of the cage 7 is in the same sense and always double to that of cage 13.

Since the structure of the plant has now been described, we can duly proceed with an explanation of its function to facilitate understanding of the further successive embodiments—which shall, from time to time, be mentioned in the text.

Let us now suppose that it will be desired to wind the crown layer 2 over the core strand 1 (see FIG. 2).

On machine 4 (FIG. 3) therefore, there will be disposed the bobbin 11 which holds the strand that was already prepared in advance on another machine; on machine 5, on the other hand, there will be disposed the necessary bobbins for paying-off the nine wires required for the crown layer, for example, nine bobbins each one having a single head.

In the first place, it must be remembered that the movement of the wire in direction F, is obtained by means of a device for pulling the cord (not represented) that is situated to the right-hand side of the plant in the drawing; moreover, the shuttles 10 and 16, being freely rotating around their axes, are stationary during functioning of the plant because of the weight of the bobbins placed inside them, while the respective cages rotate around them. These cages are moved by an actioning device (not illustrated also).

The wires, payed off by the bobbins, are removed from machine 5 and taken over to machine 4—along a trajectory which, at first, coincides with the axis of the machine, between rollers 17 and 14, and hence, developed along the outer surface of the machine between roller 14 and roller 15, to then, once again, coincide with the machine axis, downstream of the roller 15.

It can be easily seen from the drawing, that the directions of movements for the wires (along the two tracts of trajectories which coincide with the machine axis) are contrary to one another, i.e., the said wires, after having been extracted from the cage, in moving along the axis of the latter in a certain direction, go into 're-verse' (on roller 14) which change, consequently causes them to move at first substantially in the opposite direction, and hence, downstream of roller 15, in exactly the opposite direction.

Moreover, on roller 14, the nine wires undergo a first torsion with cabling of them into strands. After this, the strands undergo a second torsion on roller 15, in the same sense as the previous one.

From here, the so-formed strand, which is now double-twisted, is taken to the machine 4, on which the formed strand moves along a second trajectory still being outside of the machine itself in a direction that is, at first, coincidental with the axis of the latter, i.e., upstream of the roller 8, when, it is developed along the external surface of the cage between roller 8 and roller 9, and finally, becomes again coincident with the axis of the machine, i.e., downstream of the roller 9.

On roller 8, whose axis rotates together with the cage 7, which rotates in the same sense as the cage 13, this strand then undergoes a torsion in the inverted sense with respect to the two previous torsions, i.e., it now becomes 'un-twisted'.

In now considering that the rotation speed of the cage 7 is always twice that of the cage 13, it is clear that the 'un-twisting' caused by roller 8, consequently neutralizes the two previous torsions, and therefore, the strand 're-separates' into the nine wires that form it. These, in being stressed, but not twisted, become disposed parallel and adjacent to each other, and flow onwards, with maintenance said disposition arranged on the external surface of the cage 7, to eventually arrive at the pre-forming pin 9, onto which they are partially wound by means of modifying the direction of movement for, in this way, issuing forth from this pin 9 in the sense of direction that lies parallel to the axis of the machine 4.

Onto the same pin 9, there also arrives the core strand 1, strand 1 being payed-off by the bobbin 11 having a stationary axis, and being guided by the wire-guiding roller 12; obviously, generally speaking, instead of the simple strand 1, there will be payed-off the cord portion to be covered with a crown layer as, for example, when in the case of realizing the final stage of the cord under consideration, the bobbin 11 pays-off a cord comprised by the strand of core 1 wound over by the first crown layer 2.

In any case, the said strand is not wound onto roller 9, but is only tangent to it, for which reason, the rotation of the axis of roller 9, together with the cage 7, does not interfere with this cord portion.

The rotation of this pin around the core strand, has, on the contrary the effect of winding the crown layer around the said cord portion.

In fact, the nine wires that meet parallel to each other on pin 9, coming from a direction which is incident with respect to the machine axis, winds for a certain tract around the surface of roller pin 9 that has a curved radius approximately chosen in proportion to the diameter of the wires utilized, and which then undergo a pre-formation, i.e., a permanent deformation flexionally, along a generatric of their axial development, seeing that they are not 'twisted', and simultaneously to this flexional deformation, the wires undergo a torsion in an opposite sense, and of an identical width as with respect to the 'un-twisting' undergone on roller 8.

Due to the presence of the core, the wires cannot however, become cabled together into strands, but they are forced into being wound, i.e., in mantle fashion, around the said core, in this way to produce the desired crown layer.

The thus-produced cord, now leaves the machine 4 by following a certain direction of movement for reaching the 'known' treating-devices, and from there, to be collected which generally takes place on a bobbin, so much so that this bobbin is already disposed in readiness for being inserted once again into the plant, for example, in substitution of the bobbin 11, for proceeding with the phase of another layer being wound over it.

In fact, for disposing on the cords (produced as above) the subsequent crown 3 layer (See FIG. 2) and, in particular, the layer with the fifteen wires, it will now suffice to place on the shuttle 10, the bobbin of the cord that has been prepared (3S+9S), and to dispose on the shuttle 16 the bobbins necessary for distributing fifteen wires, after which the new phase of the process will develop exactly as the preceding one so that to be collected (upon issuing forth from the plant) will be the cord 3S+9S+15Z.

It is clear, as far as concerns the winding direction of the core and the crown layers, that it will suffice to select opportunely the direction of rotation for the machine cages.

We can now make certain precise statements. First and foremost, seeing that the wires move through the plant according to diverse directions, as with regard to an established reference, in the present description we have defined the direction (FIGS. 3 and 4) following which the produced cord departs from the point where the crown layer winding takes place, as the 'advancing direction'—to which the other moving directions of the wires refer.

Moreover, as a convenient practical solution for the realization of the apparatus described, there is represented in the drawing, the version whereby said 'advancing direction' and the axes of the machines 4 and 5, are disposed one co-axial to the other, in linear succession.

As far as concerns the coupling between the two machines, for illustration purposes only, reference has been made in the drawing to the joint that is coaxial to the machine itself. But actually, any type of coupling may result as being adapted for the purpose and responding to our invention, if it proves to be adapted for establishing and for maintaining the required ratio of 2:1 between the rotation speed of the cage 7 in respect to cage 13; contrarily, for more mechanical reasons, concerned with the passage of the wires, a 'mechanical joint' co-axial with the machines themselves, neither results in being more practical nor more suitable.

In any case, at this point, the selection of the most apt type of coupling does not present any difficult problem for any technician of the art.

To end with, there has also been foreseen the disposing of the pre-forming pin 9 at the plant exit. Nonetheless, it is also quite possible to dispose it at the beginning of the course for the crown wires, for example, in coincidence with the roller 17, or else by means of inserting a special pin into the tract of the wire trajectory between the rollers 17 and the roller 14. However, the solution illustrated, is adapted to avoid substantial disturbance of the material during the working process, with advantageous behavior results in the finished cords, during exercise.

It has already been stated that the plant of our invention allows for combining together two operations into a single phase, i.e., to simultaneously carry out two operations which, in the state of the art had to be carried out separately. More particularly, the plant of our invention enables the cabling of the core and the enveloping of it with a first crown layer in a single step.

As a matter of fact, FIG. 4 illustrates the above-said convenient form of realization. In said figure also, for clarification purposes, the reference numerals of the parts which are common to the machine of FIG. 3, have been omitted.

Let us again consider the above-stated cord 3S+9S+15Z. The core of this cord is constituted by a strand formed by three single wires twisted together.

Referring to FIG. 4, in the shuttle of the machine 4, there are now disposed the three bobbins 19, each one having a single head, instead of the single bobbin of the strand 1×3 already considered in FIG. 3.

It becomes evident here that, at least theoretically speaking, instead of having three 'single-headed' bobbins, there can also be utilized a single 'three-headed' bobbin. Furthermore, the convenience in practice, of realizing 'plural-headed' bobbins, will be dealt with on and off.

We wish to specify moreover, that the solution of the 'plural-headed' bobbins even though not expressly stated previously, is naturally applicable also in the case of the bobbin 18 for the crown wires.

Referring now to what has already been said for illustrating the machine 5, also in this case, the wires fed by the three bobbins 19 are extracted from the cage and taken to the meeting-point with the other wires of the crown layer, by following a trajectory that is, at first, coincident with the axis of the cage between the wire-guiding rollers 20 and 21, then, developed on the external surface of the cage between rollers 21 and 22, and finally, coinciding with the axis of the cage, once again. Also here, the directions of movement of the wires in the two tracts of the trajectory, that are coincident with the axis of the cage, differ from one another; the direction at the exit of roller 22, being coincident with the already mentioned 'advancing direction'. Each one of the rollers 20, can be used as the pre-forming device for the said wires in a very similar way to the already illustrated pre-forming pin 9, for the crown wires. Besides this, it is worthwhile to hypothesize a solution of a single pre-forming pin disposed in the tract between the roller 20 and roller 21.

By recollecting still what has already been previously stated, it is now quite easy to comprehend, from FIG. 4, how the three core wires undergo (during their course up to roller 9) a double-torsion, and precisely, a first torsion on the roller 22. Thus, on issuing from this latter roller, a twice-twisted strand 1×3 is had, comprising precisely the core of the cords in formation. For that matter, nothing else changes in the process specified before, the description of which results in being exactly applicable also when making reference to the plant of FIG. 4.

This alternative embodiment is extremely convenient for the layered cords, which foresee a single crown-layer. It will suffice to cite, for example, the 2+7, now widely in use, that is comprised of a core of two twisted together wires, and by a crown layer made of seven single wires.

The cords provided by the plant according to our invention, have proven to possess quite high characteristics. In particular, they denote a greater regularity in their geometrical configuration and a greater uniformity in the stress of the single wires which comprise the cords. Consequently, these cords are exempt from the non-infrequent ruinous phenomenon found in tracts, of a wire in the core body issuing out-of-course. Such a phenomena is quite recognizable in the 'humped' appearance which the cord surface assumes.

It is believed, without wishing to be bound down in any way to the following hypothesis, that this probably is due to the fact that all the wires of the crown layer (of the cords produced as described above) result in being deformed by flexions, in identically the same manner, along one of their generatrixes and with their being axially twisted, rather than being deformed by flexions, along a cylindrical helix developed on their surface which, on the contrary, takes place in teh case of the cords produced with the usual 'laying' machines available.

To this diverse type of deformation, must be attributed the improvements obtained with the cords of the invention, in particular, as far as concerns their resistence to un-winding in the zone of the 'cut', as well as to their resistence to fatigue during exercise.

It is clear that forming cords having a single layer, as, for example, the above-cited 2+7, in a single phase instead of the usual two phases (first forming the core and collecting it on a bobbin; then forming the complete cord), and also by employing the double-torsion cording machines which are very fast, in substitution of teh former slower 'laying' machines, a substiantial increase in productivity is obained with consequent substantial economic advantages as well.

It is to be understood that the invention has been described solely by way of non-limiting example, and that modifications and alternative variations may be made by those skilled in the art without departing from the spirit of the invention except as it may be limited by the claims.

What is claimed is:

1. A method for producing metallic cords adapted for reinforcing an elastomeric structure, each said cord having a central core and at least one crown layer comprising metallic wires, the wires of each layer being helically wound, and substantially parallel to each other around the radially innermost layers and the said central core, the method comprising first pre-disposing a pay-off of a first group of wires to form the innermost portion of the cord, and a pay-off of a second group of wires for the relative crown layer, and then applying to the wires of each group, a force that distributes the wires fed from their relative pay-off bobbins, then permanently deforming, at least flexionally, the wires of said second group and winding said wires helically and parallel to each other around said cord portion which is exposed to the said second group, thereby producing the crown layer, and guiding the so-formed cord towards a means for collecting said cord, said method comprising the steps of:

(a) distributing the said second group of wires in the form of a bundle of distinct wires which are not cabled together;

(b) rotating said wires in the same sense twice to form a double-twisted strand;

(c) untwisting said strand, with the same entity as that of the two previous twistings to separate said strand into its wires and disposing these wires, both parallel and side-by-side, conferring to the thus disposed wires that are also permanently deformed by flexions, a torsion having the same entity as that of the previous untwisting while simultaneously winding the said separated wires around the wires of said first group, thereby to form the crown layer on said innermost cord portion.

2. The method of claim 1, wherein the said wires of the second group are deformed by flexion successively to said untwisting.

3. The method of claim 1, wherein the said two successive torsions of the step (b) are conferred, by pulling said wires along a first trajectory which rotates around an axis, but not being coincident with it, and with having initial and end tracts on the said axis, the direction of movement of said wires along said trajectory, in said initial and end tract, being in contrast with one another.

4. The method of claim 1, characterized by the fact of conferring the said un-twisting and successive torsion of the step (c), by pulling said strand along a second trajectory that rotates around an axis, but not being coincident with it, with having initial and end tracts laying on said axis, the directions of movement of the said strand along a second trajectory in said initial and end tracts, being in accordance with each other.

5. The method of claim 3 or 4, characterized by the fact that the rotation speed of said second trajectory is in the same sense and of a double entity, with respect to the rotation speed of said first trajectory, the moving direction of said wires in the respective end tract of said first trajectory, and the initial tract of said second trajectory, being in accordance one with the other.

6. The method of claims 1, 2, 3 or 4, for forming in a single step, the said central core and the crown layer that is radially innermost, and characterized by the fact of comprising, in the following order, the complementary operations of:

distributing the wires of said first group in the form of a bundle of distinct wires disposing them reciprocally parallel and side-by-side to each other;

to permanently deform, by flexions, these so-disposed wires;

to confer to said wires two successive torsions in the identical sense, so as to realize a double-twisted strand, which constitutes the said central core; said two successive torsions being conferred with the same rotation for conferring the said un-twisting and successive torsions to the wires of the said second group.

7. The method of claim 6, characterized by the fact that said two successive torsions are conferred by pulling said wires along a trajectory which rotates around an axis, but not coincident with it, and with having initial and end tracts on said axis, the directions of movement of said wires along said tracts, in said initial and end tracts opposing each other.

8. The method of claims 1, 2, 3 or 4, characterized by the fact of disposing said 'advancing direction' and the axes of rotation of said trajectories, co-axially to one another, and in linear succession.

9. An apparatus for manufacturing metallic cords adapted for use as reinforcing elements in elastomeric structures, said cords being constituted by a central core and at least one crown layer of wires, said wires being single metallic wires or strands, with the wires of each crown layer helically wound and parallel to each other around the radially innermost layers and said central core, said apparatus being characterized in that it comprises:

a first machine of the double-torsion type, consisting essentially of a cage rotating around its own axis and a shuttle which is co-axial to said cage and disposed inside the latter and freely rotating around its own axis, and being adapted for sustaining the means for distributing a first group of wires constituting the cord portion onto which a crown layer is wound;

a second machine of the double-torsion type, consisting essentially of a cage and shuttle similar to those of said first machine, the shuttle of said second machine being adapted to sustain the means for distributing a second group of wires in the form of a bundle of distinct wires, for winding into said crown layer;

a pre-forming device, adapted for permanently deforming, by flexions, the wires of the said second group;

a device for coupling together the said first and second machines and being adapted for differentiating the rotation speeds of the said cages, with maintainence of said velocities at a constant ratio of 2:1 respectively; and a means for pulling the wires, for stabilizing the torsions, and for collecting the cords as they are produced.

10. The apparatus of claim 9, characterized by the fact that said means for distributing the said first group of wires, comprises a bobbin that freely rotates around its own axis and is disposed on a shuttle orthogonal to the axis of the corresponding cage, said bobbin containing the cord over which the crown layer is to be wound.

11. The apparatus of claim 9, characterized by the fact that said means for distributing the said second group of wires, comprises a plurality of bobbins each one freely rotating around its own axis, and disposed orthogonaly to the axis of the cage, with each bobbin containing a single metallic wire, the number of bobbins equalling the number of wires forming said crown layer.

12. The apparatus of claim 9, characterized by the fact that said distributing means for said second group of wires, comprises at least one bobbin freely rotating around its own axis and disposed orthogonally to the axis of the cage with each bobbin containing a plurality of single metal wires, with the number of said wires in said bobbins equalling the number of wires forming said crown layer.

13. The apparatus of claim 9, characterized by the fact that said pre-forming device comprises a pin that freely rotates around its own axis orthogonally disposed with respect to the axis of the corresponding cage.

14. The apparatus of claim 9, characterized by the fact of said second apparatus comprising means for guiding the wires of the said second group along a trajectory initially coincident with the axis of the cage, then traversing said cage from the inside towards the outside, and thence, developing along the external surface of said cage, to finally, once again, coincide with the axis of said cage, external to it and at the opposite side with respect to said initial tract.

15. The apparatus of claim 9, characterized by the fact that said first machine comprises means for guiding the wires of said second group along a trajectory that is always outside the corresponding cage, initially to be coincident with the axis of this cage, and thence to be developed along the external surface of the latter, to finally once again coincide with said axis from the side opposite with respect to said initial tract.

16. An apparatus of claim 14, characterized by the fact that said preforming pin is also a guiding means to the trajectory of the second group of wires at the point where said trajectory becomes coincident with the axis of said first machine.

17. The apparatus of claim 9, for forming in a single phase, the said central core and the crown layer radially innermost, characterized by the fact that said means for distributing the first group of wires, are adapted to distribute said wires in the form of a bundle of distinct wires, and that said first machine also comprises a preforming device for permanently deforming, at least by flexions, each wire of said bundle, and for guiding said wires along a trajectory that is initially coincident with the cage axis while traversing said cage from the inside towards the outside, to thence by developed along the external surface of said cage, and to coincide again with said cage axis, externally to it, and from the opposite side with respect to the initial tract.

18. The apparatus of claim 17, characterized by the fact that said pre-forming device comprises a roller on which the wires of said bundle, which are parallel and side-by-side to each other, are partially wound, said roller also being a guiding element for the trajectory of said bundle of wires, upstream of the point where said initial tract of the trajectory, which is coincident with the axis of said cage, moves away from said axis for departing in the direction along the external surface of said cage.

19. The apparatus of claims 9, 10, 11, 12, 13, 14, 15, 16, 17 or 18 wherein said first and second machine are disposed in linear succession, and coaxially to each other and to said advancing direction.

20. A metallic cord comprising a central core and at least one crown layer, the wires of each of the crown layers being helicoidally wound parallel to each other, around the radially inner layers and the said central core, by the method of claim 1 and characterized by the fact of said wires of the crown layers being permanently deformed flexionally along a generatrix of their development, and axially twisted, individually.

21. A metallic cord comprising a core and at least one crown layer, the wires of the crown layers having been wound helically with the apparatus of claim 9, the wires of the crown layer having been deformed flexionally along a generatrix of their development and axially twisted individually.

* * * * *